US005667212A

United States Patent [19]

Merkli

[11] Patent Number: 5,667,212

[45] Date of Patent: Sep. 16, 1997

[54] GATHERING AND WIRE-STITCHING MACHINE

[75] Inventor: Peter Merkli, Oftringen, Switzerland

[73] Assignee: Grapha-Holding AG, Hergiswil, Switzerland

[21] Appl. No.: 427,228

[22] Filed: Apr. 24, 1995

[30] Foreign Application Priority Data

Apr. 26, 1994 [CH] Switzerland ..... 01284/94

[51] Int. Cl.[6] ..... B65H 39/00

[52] U.S. Cl. ..... 270/52.16; 270/52.18; 270/52.28; 270/52.29

[58] Field of Search ..... 270/52.18, 52.16, 270/52.26, 52.27, 52.28, 52.29; 198/644

[56] References Cited

U.S. PATENT DOCUMENTS

| | | | |
|---|---|---|---|
| 1,492,760 | 5/1924 | Sproul | 198/644 |
| 2,810,468 | 10/1957 | Faeber et al. | 198/644 |
| 2,845,264 | 7/1958 | Faeber | 270/52.29 |
| 2,966,354 | 12/1960 | Gore | 270/52.26 |
| 3,032,336 | 5/1962 | Heigl et al. | 270/52.18 |
| 3,366,225 | 1/1968 | Thorp | 198/644 X |
| 3,807,547 | 4/1974 | Mueller | 198/644 |
| 4,236,706 | 12/1980 | Schlough | 270/52.18 |
| 4,614,290 | 9/1986 | Boss | 270/52.18 X |

FOREIGN PATENT DOCUMENTS

| | | |
|---|---|---|
| 0 346 579 | 4/1989 | European Pat. Off. . |
| 3602319 | 9/1986 | Germany . |
| 519993 | 4/1972 | Switzerland . |
| 2047664 | 12/1980 | United Kingdom . |

*Primary Examiner*—Hoang Nguyen
*Attorney, Agent, or Firm*—Spencer & Frank

[57] ABSTRACT

A gathering and wire-stitching machine for printed sheets has a gathering section and includes at least one run of an endlessly circulating pulling apparatus and supporting elements fastened to the pulling apparatus and forming at least a part of a saddle-shaped support for the printed sheets which are successively deposited thereon in a straddled position. The gathering section leads into an adjoining downstream stitching section for stitching the printed sheets which are deposited one on top of the other. The saddle-shaped support extends over the gathering section as well as the stitching section and includes, at least in a partial section, supporting elements arranged side by side above the pulling apparatus, with each supporting element having one side with a sloping support surface.

21 Claims, 2 Drawing Sheets

17
3
13
3
12
4
3

GATHERING AND WIRE-STITCHING MACHINE

CROSS-REFERENCE TO RELATED APPLICATION

This application claims the priority of patent application Ser. No. CH 01 284/94-3 filed in Switzerland on Apr. 26, 1994, the subject matter of which is incorporated herein by reference.

BACKGROUND OF THE INVENTION

The invention relates to a gathering and wire-stitching machine having a gathering section including at least one run of an endlessly circulating, chain-like pulling means to which supporting elements are fastened forming a saddle-shaped support for the printed sheets, which are successively deposited in a straddled position, and with carriers fastened to the pulling means for transporting printed sheets that are successively deposited by feeders in a straddled position, wherein the gathering section leads into an adjoining stitching section designed for stitching the printed sheets which are deposited one on top of the other.

In gathering and wire-stitching machines having a device of the type mentioned at the outset, the printed sheets to be processed pass through a gathering section on a further processing path after leaving the feeders. In the gathering section, the printed sheets are deposited one on top of the other in a straddled position. The printed sheets then pass through a stitching section adjoining the gathering section where the gathered printed sheets, forming complete printed products, are usually stitched twice along the length of the fold.

In the longer gathering section, the deposited printed sheets are placed into the charging position for the next feeder by the carriers provided at least one pulling means. For this purpose, it is known to use a roller chain in which every second chain link is provided with sloping support surfaces on both sides of the roller chain to form an uninterrupted saddle-shaped support, with the upper edge of the support being disposed approximately above the longitudinal center axis of the roller chain.

The gathering section, or that is the conveying chain allocated to the gathering section, ends before the stitching section which follows the gathering process due to the afore-mentioned configuration of the support which prevents a feeding movement of a bending arrangement, which is driven upwardly, in the longitudinal center axis of the roller chain or the upper run of the pulling means in the form of a driven linkage.

The completed printed products are grasped at or after the end of the gathering section for further transport to the stitching section by a conveying arrangement which is suitable for implementing the stitching process, for example, by two driven linkages comprising the pulling means as a continuation of the support of the gathering section, or by so-called finger strips, placing the printed products into the desired stitching position so that they can be stitched and transported further after stitching. The means necessary for this process are very complex.

SUMMARY OF THE INVENTION

It is an object of the invention to provide a gathering and wire-stitching machine, and also a drum gathering and wire-stitching machine having a plurality of gathering and stitching sections, of the type mentioned at the outset, which allows a simple configuration for a reliable processing of printed sheets.

The above and other objects are accomplished according to the invention in the context of a gathering and wire-stitching machine for printed sheets having a gathering section including at least one run of an endlessly circulating pulling means and supporting elements fastened to the pulling means and forming at least a part of a saddle-shaped support for the printed sheets which are successively deposited thereon in a straddled position, with the gathering section leading into an adjoining downstream stitching section for stitching the printed sheets which are deposited one on top of the other, wherein: the saddle-shaped support extends over the gathering section and the stitching section and further comprises, at least in a partial section, supporting elements arranged side by side above the pulling means, with each supporting element having one side with a sloping support surface.

The invention thus allows a simpler and easier construction of the cooperating conveying elements which are directly affected by the gathering and stitching process as well as an alternative configuration of the gathering and stitching section.

In a particularly advantageous embodiment according to the invention, the saddle-shaped support at the gathering section is formed by two parallel runs of two endlessly circulating pulling means which ensure a reliable transport of the printed sheets also in the region of the stitching section.

The runs of the pulling means may have different lengths so that both the stitching process and the continuous processing cadence or conveying cadence can be maintained.

It is advantageous, among other things, for the gathering section and the stitching section to have a common run of a pulling means so as to ensure the gathering process, the conveyance and the stitching of the printed sheets.

Preferably, a pulling means configured with a shorter run is allocated to the gathering section without impairing the stitching process in that the pulling means of the shorter run ends before the stitching section.

Advisably, one of the pulling means forming the support can end before the stitching section, for example, the pulling means with the shorter run, while the resulting one-sided gap or interruption of the support is eliminated by means of a stationary directing member which cooperates with the supporting elements fastened to the adjacent pulling means.

To assist the transition of the printed sheets from the support formed by pulling means and supporting elements to a support that is provided with a stationary directing member, a guide element can be arranged to adjoin the conveying end of the shorter pulling means, with the guide element ascending approximately in the longitudinal center axis of the support approximately to the upper edge of the support.

Advantageously, the pulling means comprise link chains which prove to be a simple drive element.

The device according to the invention allows an advantageous configuration of the bending arrangement, which must be raised to the upper side of the support from below, or of the stationary directing member which is allocated to the transition point between the end of the shorter pulling means after the gathering section and the stitching section, in that the support is provided at its upper end with a passage opening for the bending arrangement. The opening separates the upper edges of the support surfaces of the supporting elements of two pulling means or of the supporting elements of one pulling means and the stationary directing member, the bending arrangement being disposed in a guide housing approximately in the longitudinal center plane of the support, and/or the support is provided with a guide element that is allocated to the transition point.

These alternative constructional characteristics, which assist the further development of the gathering and wire-stitching machine according to the invention, allow the configuration of the support with two parallel runs of pulling means between whose effective conveying runs a perpendicularly standing strip can be arranged which forms the ridge of the saddle-shaped support and/or allow the possibility of combining a run with a stationary directing member for forming the support, while segments of the gathering section and of the stitching section may be provided with these.

Advisably, the lateral support surfaces of the support formed by the supporting elements extends downwardly over the pulling means or link chains to provide a cover for the same.

A further advantage can be accomplished with the subject matter according to the invention by configuring the supporting elements according to different embodiments and by connecting the supporting elements to the pulling means.

Particularly, when using a link chain, the plates of the chain links can be provided with a one-piece unitary construction so that they are connected to the laterally sloping support surface of a supporting element or, in a different embodiment, are provided with an additionally supporting support bridge extending approximately perpendicularly. Sheet steel is among the materials having the necessary stability for the chain links.

Alternatively, a supporting element is advantageous which can be plugged onto the link chain by means of a resilient clamping lock. A plastic material as well as sheet steel may be suitable for this purpose.

In a simple embodiment of the supporting element, the bolts which laterally extend beyond the connecting plates of an element of the link chain are provided for the purpose that they can receive a yoke-shaped adapter in a force-transmitting and/or form-fitting manner, the adapter being connected to the supporting element.

For this purpose, the yoke-shaped adapter is provided with lateral clamping strips having latching grooves or the like on the interior side facing the chain links.

To accomplish a largely uninterrupted support, the support surfaces of the supporting elements project beyond the division of the link chain and thus prevent the formation of a gap.

If, with respect to their width, the supporting elements are configured so that they extend asymmetrically counter to the direction of conveyance over more than one chain division, they can be used as ejectors in the deflection regions of two parallel runs.

The spacing of the carriers can be changed so as to accomplish cost-efficient processing which is adapted to the sizes of the printed sheets.

The ridge strip, the bending arrangement and/or the guide element between the supporting elements or the stationary directing member can be arranged by means of diverging runs of two pulling means on a segment of the support.

BRIEF DESCRIPTION OF THE DRAWINGS

These and other features and advantages of the invention will be further understood from the following detailed description of the preferred embodiments with reference to the accompanying drawings, wherein.

DETAILED DESCRIPTION OF THE PREFERRED EMBODIMENTS

Figure 1:
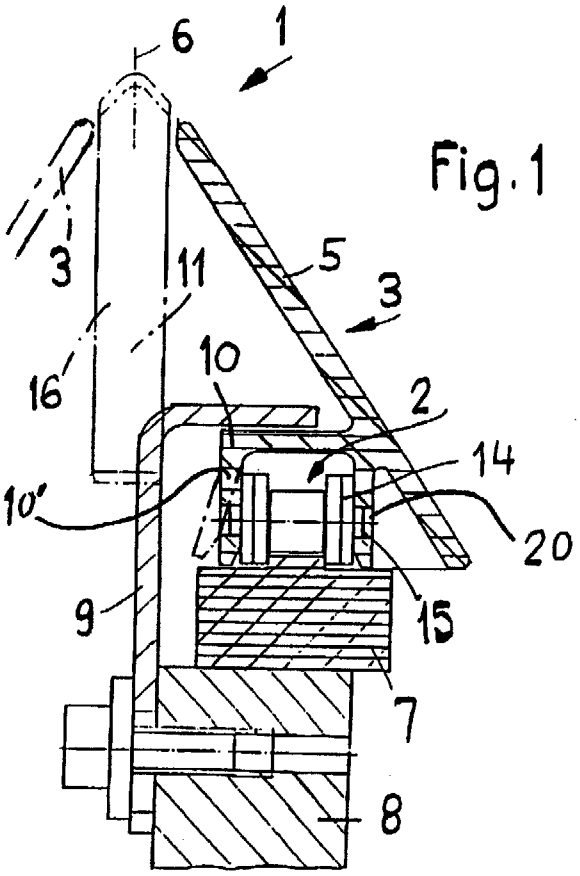
FIG. 1 is a cross section through a supporting element attached to a pulling means according to line I—I in FIG. 2.
Figure 2:
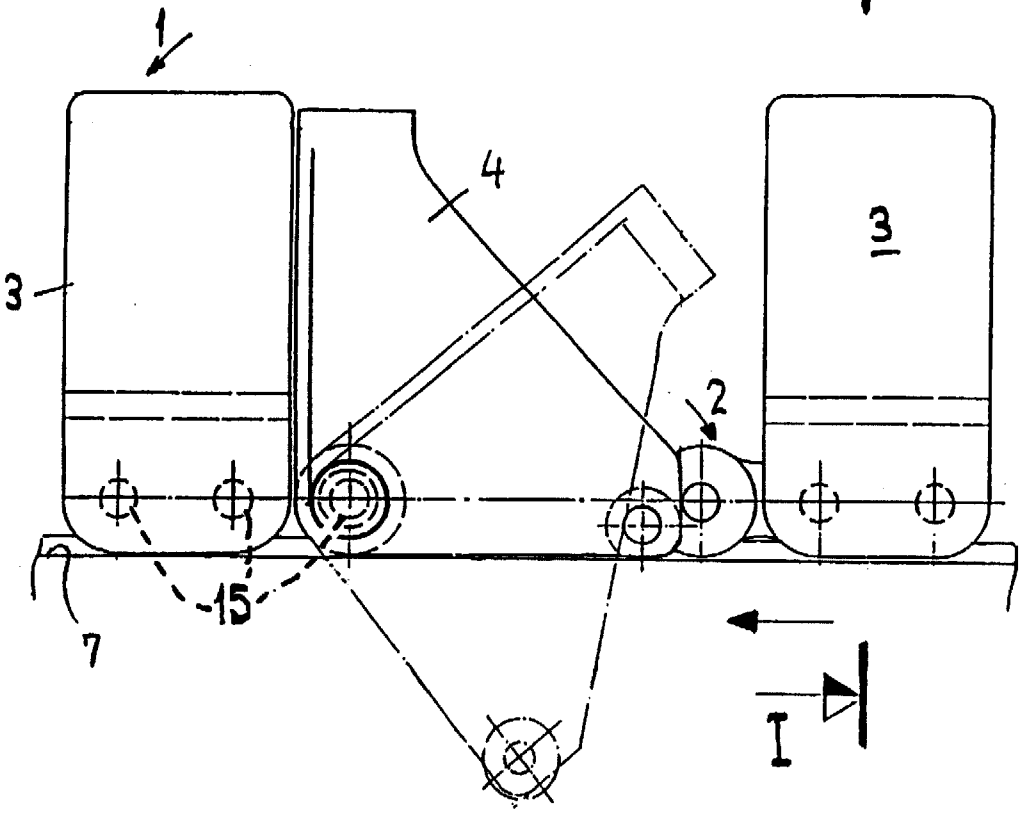
FIG. 2 is a side view of the support formed of supporting elements.

FIGS. 1 and 2 show a segment of a support 1 which is chargeable by feeders of a gathering and wire-stitching machine (not shown), for example, at the gathering section. Support 1 is formed by an upper run of an endlessly circulating driven pulling means 2, here link chain, having supporting elements 3 attached to the link chain. Synchronized with the processing cadence of the gathering and wire-stitching machine, carriers 4 follow which are successively attached to the pulling means 2. The carriers are guided past the feeders and take over respectively transport further the respective printed sheet which is in a ready, straddled position. The carriers 4 are respectively arranged between two supporting elements 3 which succeed one another, for which purpose, for example, a chain section of two chain links is required. Additionally, carriers 4 can be pivotally seated on one side at the pulling means 2, as is shown, preferably at the chain joints formed by bolts 15 that extend through the connecting plates 14 of the link chain around an axis disposed at a right angle to the direction of conveyance so that they can be lowered downward counter to the direction of conveyance after passing through the stitching section, as is shown in FIG. 2.

FIG. 1 illustrates, according to one embodiment, a cross-sectional shape of a supporting element 3 which is fastened to a pulling means 2 implemented as a link chain. In principle, supporting elements 3 are provided above pulling means 2 with a sloping support surface 5 on one side which respectively forms part of the saddle-shaped support 1 which is approximately evenly distributed over the longitudinal center plane 6 of the gathering section and the stitching section.

The dot-dash line in FIG. 1 shows a further supporting element 3' which complements the other supporting element 3 to form the saddle-shaped support 1. The pulling means 2 respectively required for this purpose have the same speed and are also driven in the processing cadence. Chain link 2 has an upper run that rests on a longitudinal guide 7 which is connected to the machine frame 8. A bracket-like rail 9 is provided to prevent the link chain or the upper run from lifting off or tilting, with the rail extending above an adapter 10 which is connected to supporting element 3 along link chain 2. A lower run of link chain 2 which moves in the opposite direction is guided by an oppositely disposed bracket of the same type (not shown) to prevent it from sagging. The rail 9, in turn, is screwed to the machine frame.

A ridge strip 16 forms the ridge-like upper edge of support 1 and possibly accommodates a bending arrangement 11. During the stitching process in the stitching section, the ridge strip can be respectively lifted through a passage opening between the upper edges of supporting elements 3 and 3', as shown, and again lowered into its resting position whose lateral sides 10' are provided with grooves or bores 20.

Figure 3:
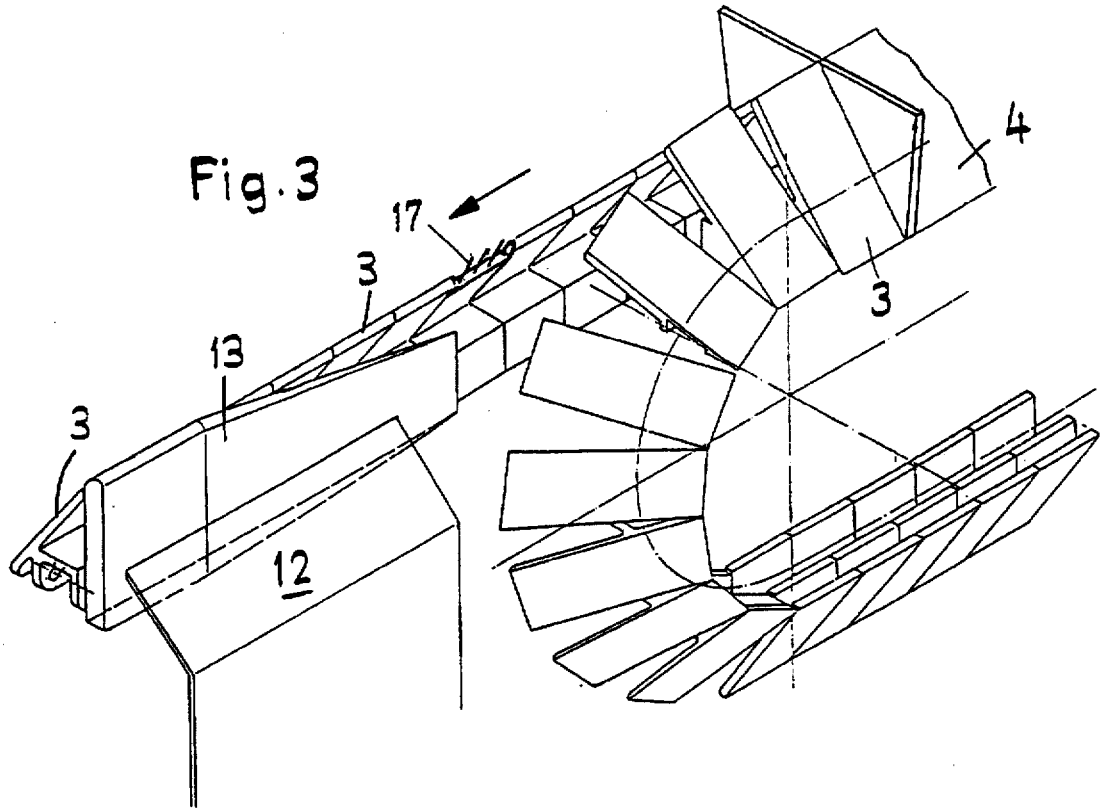
FIG. 3 is a perspective view showing a transition point from the gathering section to the stitching section.

For forming support 1 in the gathering section, two parallel runs of pulling means in the form of driven link chains are illustrated, of which the rearward one in FIG. 3 is longer than the forward one. The forward pulling means is deflected by 180° before the stitching section, whereas the rearward pulling means extends beyond the stitching section. In this manner, a transition point is created between gathering section and stitching section. In order to ensure the processing cadence and the correct position of the printed sheets during transport, this transition point has a special configuration.

In place of the supporting elements 3 completing the support 1 at the gathering section, a stationary directing member 12 is adjoined at a small distance from the shorter run. The stationary directing member 12 is oriented according to the support surfaces 5 of the supporting elements 3 forming a complete support for the printed sheets on one side of the longitudinal center plane 6. To further assist a problem-free functioning of the transfer point, a guide element 13 which cooperates with the stationary directing member 12 is provided and disposed approximately in the longitudinal center plane 6 seen in the direction of conveyance of the printed sheets. Guide element 13 has a continuously rising guide section which, after reaching the upper edge of the support 1, transitions into a section that is parallel to the upper edge of the support.

With their lower edge, the support surfaces 5 of the supporting elements 3 reach approximately the height of the longitudinal guide 7 of the link chain 2 to protect the chain from external influences as shown in FIG. 1.

Supporting elements 3, are preferably comprised of a plastic material, and are provided with an adapter 10 which is connected to the support surface 5 and which serves as a fastening element to the link chain 2. This adapter 10 has a yoke-shaped cross section so that it can be used as a resilient clamping lock at the link chain 2 and can be plugged onto and removed from the chain. The ends of the bolts 15 that laterally extend beyond the connecting plates 14 of the link chain 2 serve as a peg-like arrangement at which the adapter 10 or a supporting element, which is provided with the latching grooves or bores 20, is held. A supporting element 3 at the pulling means is removed or replaced by deformation or by lifting the lateral clamping strips off the ends of bolts 15.

Supporting elements 3 have upper edges that are provided with protruding bristles 17 or retaining springs to reduce the sliding of the printed sheets at the support when the gears of the pulling means come to a stop.

It will be understood that the above description of the present invention is susceptible to various modifications, changes and adaptations, and the same are intended to be comprehended within the meaning and range of equivalents of the appended claims.

What is claimed is:

1. In a gathering and wire-stitching machine for printed sheets having a gathering section including at least one run of an endlessly circulating pulling means and supporting elements fastened to the pulling means and forming at least a part of a saddle-shaped support for the printed sheets which are successively deposited thereon in a straddled position, with the gathering section leading into an adjoining downstream stitching section for stitching the printed sheets which are deposited one on top of the other, the improvement wherein:

the saddle-shaped support extends over the gathering section and the stitching section;

said at least one run comprises parallel runs of two endlessly circulating pulling means, the two runs having effective conveying portions of different lengths;

said supporting elements include two arrangements of side by side supporting elements, each arrangement fastened to a respective one of the endlessly circulating pulling means, each supporting element having one side with a sloping support surface that has a section above the respective endlessly circulating pulling means, said two arrangements of supporting elements forming two support surfaces facing away from each other.

2. The machine according to claim 1, wherein one of the two endlessly circulating pulling means is a common run for the gathering section and the stitching section.

3. The machine according to claim 1, wherein the shorter run of the two endlessly circulating pulling means is allocated to the gathering section.

4. The machine according to claim 3, wherein the shorter run ends before the stitching section and said machine further comprises a stationary directing member forming a further support surface facing away from the support surface formed by adjacent supporting elements fastened to the pulling means of the longer run in a region of the stitching section.

5. The machine according to claim 4, further comprising a guide element located at a transition region between the gathering section and the stitching section, aligned in a direction of conveyance, between a downstream end of the shorter run of the pulling means and the stationary directing member approximately in a longitudinal center plane of the support, with the guide element continuously rising toward an upper edge of the supporting elements.

6. The machine according to claim 5, wherein the guide element is disposed in an opening between the supporting elements in the stitching region and the stationary directing member.

7. The machine according to claim 5, wherein the supporting elements and the stationary directing member each have a surface that extends downward over a respective one of the pulling means.

8. The machine according to claim 1 wherein the saddle-shaped support includes an upper end provided with a passage opening separating upper edges of the oppositely disposed support surfaces through which a ridge strip can be raised.

9. The machine according to claim 1, wherein the two pulling means each comprises a link chain.

10. The machine according to claim 9, wherein each supporting element includes a resilient clamping lock for fastening the supporting element to the link chain in a plug-in manner.

11. The machine according to claim 10, wherein the resilient clamping lock comprises a yoke-shaped adaptor and the link chain includes connecting plates and bolts connecting the connecting plates and having bolt ends which laterally extend beyond the connecting plates to accommodate the yoke-shaped adapter.

12. The machine according to claim 10, wherein the yoke-shaped adaptor has lateral clamping strips provided with latching grooves on an interior side facing the link chain.

13. The machine according to claim 9, wherein the supporting elements extend laterally beyond a width of the link chain.

14. The machine according to claim 9, wherein with respect to their width, the supporting elements are configured such that they extend asymmetrically counter to a direction of conveyance over more than one chain division.

15. The machine according to claim 9, further comprising longitudinal guides against which the chain links rest.

16. The machine according to claim 9, further comprising a longitudinal guide for supporting an upper run of the link chain.

17. The machine according to claim 1, wherein the pulling means comprises a link chain having chain joints and said machine further comprises carriers fastened to the chain joints of the link chain.

18. The machine according to claim 17, wherein the chain joints each include a bolt and each carrier is articulated to a respective one of the bolts so that the carrier can be lowered downwardly.

19. The machine according to claim 17, wherein the carriers on the pulling means are adjustably spaced relative to one another.

20. The machine according to claim 1, wherein the runs of the two pulling means are arranged at least in one segment of the support in a diverging manner.

21. The machine according to claim 1, wherein the supporting elements include one of projecting bristles and retaining means at their upper end for reducing sliding of printed sheets supported on the supporting elements.

* * * * *